United States Patent [19]

Breckenridge

[11] Patent Number: 5,050,314

[45] Date of Patent: Sep. 24, 1991

[54] METHOD FOR REGULATING DRYING KILN AIR FLOW

[76] Inventor: Leon Breckenridge, N. 904 Wilbur Rd., Spokane, Wash. 99206

[21] Appl. No.: 414,180

[22] Filed: Sep. 28, 1989

Related U.S. Application Data

[63] Continuation-in-part of Ser. No. 265,253, Oct. 31, 1988.

[51] Int. Cl.[5] ..... F26B 21/06

[52] U.S. Cl. ..... 34/34; 34/226; 34/231

[58] Field of Search ..... 34/331, 226, 50, 46, 34/34, 22

[56] References Cited

U.S. PATENT DOCUMENTS

| | | | |
|---|---|---|---|
| 1,432,248 | 10/1922 | Hirt . | |
| 1,919,646 | 6/1931 | Woolhouse . | |
| 3,196,554 | 7/1965 | Smith | 34/231 X |
| 4,599,808 | 7/1986 | Gelineau et al. . | |

*Primary Examiner*—Albert J. Makay
*Assistant Examiner*—John Sollecito
*Attorney, Agent, or Firm*—Patrick Michael Dwyer

[57] ABSTRACT

A method and apparatus for regulating drying kiln airflow by disposing within drying kiln walls 1 one or more inflatable baffle bags, such as top bag 10, bottom bag 20, side bags 30, or end bags 40. Inflated baffle bags engage a stack of product 2 in such a way that drying airflow directed through the drying kiln flows through product stack 2, and not around it.

4 Claims, 3 Drawing Sheets

METHOD FOR REGULATING DRYING KILN AIR FLOW

This application is a continuation-in-part of U.S. patent application Ser. No. 07/265,253, filed Oct. 31, 1988.

TECHNICAL FIELD

This invention relates to the field of kilns used for drying various products, particularly ways and means of regulating the flow of drying air through such kilns; more particularly, the invention relates to an inflatable baffle bag air baffling system for use in such drying kilns, especially in the lumber industry.

BACKGROUND OF THE INVENTION

Drying kilns are employed to dry and season a variety of products, such as fruits and vegetables, meats and fish (often with the additional presence of smoke), various clay and ceramic products, and particularly lumber. In the lumber industry drying kilns are employed to season and to "dry" both green wood and partially air dried wood. The lumber industry uses the word "dry" to mean bringing the wood to the appropriate degree or range of moisture retained in the wood which is optimal both for the particular specie of wood and the lumber dimensions being "dried". Modern lumber industry drying kilns are actually sophisticated, controlled humidity environments.

Lumber is conventionally piled into pelletized stacks for drying. Each stack is formed by alternating layers of green lumber laid side-to-side with a layer of "stickers", each typically ⅝" by ⅝" and spaced apart by 12"-36", until a stack of the desired height is obtained. Stacks may also be stacked one atop another. Typically, an elongated structure is employed for the lumber kiln, currently between 60' and 120" long with double cribs, or tracks, holding 16,000 board feet per 10' of kiln length, in which one or more stacks of green lumber are arranged so that a flow of drying air may be directed over and through those stacks and thereby dry the lumber.

Typically, fans are employed with conventionally arranged ducting to either draw or push air through a stack in from one stack surface and out through an opposite stuck surface. Modern lumber kilns commonly recirculate the drying air back to the stack through further conventionally arranged ducting and humidity and temperature control apparatus. State of the art systems employ both temperature and humidity controls associated with fans and ducting to control the humidity and temperature of the drying air and to recirculate it through the stacks of green lumber until such time as the lumber has reached the desired degree of dryness.

The problem of directing the flow of drying air efficiently through, and not over, a stack of green lumber has long begged a solution. Woolhouse (U.S. Pat. No. 1,919,646) discloses a curtain means 16 employed in such an attempt. One device disclosed in U.S. Pat. No. 3,196,554 to Smith discloses a series of supposedly inflatable baffles for non-heated pre-drying to serve much the same purpose as a series of Woolhouses's curtains for non-heated predrying. However, no known methods effectively baffle substantially all of the drying airflow to prevent it from flowing around the product stack so that drying air flow is directed to flow only through the product stack. Also, there are no known methods for baffling substantially all of one or more of the stack surfaces to constrain drying airflow from the baffled surface and direct it through the stack.

Drying air which by-passes the product stack to flow around the top, sides, ends, and sometimes the bottom of the stack in conventional drying kilns has a higher velocity then the air which flows through the product stack, and usually has a higher temperature as well. This by-passing air flowing over the top, sides, ends, and sometimes the bottom of the stack results in the top, ends, sides, and sometimes the bottom of the stack drying faster then the rest of the stack. This can, and often does, result in overdried and degraded product on the stack surfaces which are exposed to the higher velocity and higher temperature by-passing airflow. Current methods of regulating airflow require considerable power consumption by fans since substantial amounts of drying airflow escape around the sides of the stacks of lumber, so that a greater airflow must be generated by the fans then is actually used to dry the product in the stack, thus requiring wasted and power consuming recirculation of extra air by the fans. An extra 75 fan horsepower in a kiln at 5 cents per kilowatthour costs the kiln owner $27,000 per year in electricity.

Known methods of baffling also require either uniform loads within a particular kiln or at least loads which do not vary significantly in gross surface dimension of the load over the surface of any particular side of the load. The baffles disclosed by Smith permit airflow to escape in a somewhat winding path around the edges of the various interwoven baffles therein disclosed, even if a Smith baffle could be made to inflate as disclosed and to effectively seal against the load surface at all.

It is essential that this drying operation be cost effective, particularly in times when the lumber industries is troubled because every cubic foot of air bypassing the product stack is a waste of energy and money. Thus it is necessary both to employ a standard sized kiln which can accommodate various sizes of stacked green loads of lumber and to use only the fan horsepower needed to accomplish the drying without wasted airflow.

An effective baffling system is needed which prevents excessive air flow across the entirety of any surface, especially the top surface, of a stack of lumber and which can block the flow of air past the ends of lumber in a stack, while allowing for large variations in gross stack surface dimensions and in distances between stacks and between a stack surface and a kiln wall, particularly the end wall.

DISCLOSURE OF THE INVENTION

Accordingly, it is an object of the invention to provide a system of air inflated baffle bags which provide a continuous seal against one or more of the surfaces of a green product stack.

It is a further object of the invention to provide inflated baffle bags which can maintain effective sealing with non-uniform load sizes for a particular kiln setup and which will also effectively seal stack surfaces despite stack surface irregularities of 2 feet or greater.

It is a further object of the invention to provide a means to effectively baffle a stack on one track, or crib, of a double crib kiln even when the other track is empty or only partially loaded.

It is another object of the invention to provide an inflatable sealing baffle system which will work with reversing high or low pressure fans in heated or unheated kilns and which can stand up to the very high velocities of airflow in modern kilns which can otherwise effectively blow 2×10's off the top of the load.

It is a further object of the invention to provide an inflatable baffle bag which can transmit a uniform force to any one of the surfaces of the green product stack in the range of 60 to 80 pounds per square foot or greater in order to help keep the lumber straight during drying.

It is still another object of the invention to provide an inflatable air baffling system which will reduce fan power requirements by up to 40 percent over conventional systems since virtually 100 percent of the drying air can be recirculated to flow directly through the product stack.

It is a further object of the invention to provide an inflatable air baffle system which can effectively baffle substantially all (that is, greater than 75-90%) of one or more of the surfaces of a product stack.

These and other objects of the invention which will become apparent herein are accomplished by the means and in the manner further described herein.

One embodiment of the invention is an inflatable air bag which can be inflated via one or more inflation hoses to apply, when inflated between a stack surface and one interior kiln surface, a substantially uniform pressure to that stack surface. The flat dimensions, or area coverage, of the bag are chosen to be substantially equal to or greater than the maximum stack surface dimension against which the bag is to be inflated, and the bags, inflated thickness is chosen to be greater than the maximum distance between the interior kiln surface and the point on the stack surface which is farthest away from that kiln surface. The bag is made of any material capable of sustaining repeated inflation cycles, resisting kiln temperatures and humidities, and having a burst strength greater than the maximum bag pressure to be applied to that stack surface.

Another embodiment of the invention is a system of one or more inflatable air bags which can be disposed to surround one or more of the top, bottom and side surfaces of a stack in an end flowing kiln, or of the top, bottom and end surfaces of a stack in a side flowing kiln, so that either all, or substantially all (greater than 75-90%), of the drying airflow is forced fully through the product stack and none, or substantially none (no more than 10-25%), of the drying air is permitted to go around to flow over the product stack surfaces. This embodiment will also make is possible that substantially all drying airflow with respect to at least one particular stack surface is constrained from flowing over that surface and is directed to flow substantially entirely through the product stack instead. The principal object of directing more airflow through the stack and constraining otherwise wasted airflow from flowing over stack surfaces is to increase the air velocity uniformly within the stack without increasing fan horsepower or overall fan airflow. Increased air velocity in the stack, or "through the stickers," increases the efficiency of the drying process.

In one preferred embodiment a separate bag is employed on each of four of the six surfaces of the typical, generally rectilinear product stack. In another embodiment, particularly useful in very large kilns having, for instance, double cribs each 4-5 stacks of product long and 2-3 stacks of product high, a special air bag is draped down between one or more pairs of opposed stack ends as a further aid to prevent end checking of the product. Each such bag would have a particularly soft or elastic cover to aid in effectively sealing the bag against stack ends as a further aid to prevent end checking of the product. Each such bag would have a particularly soft or elastic outer covering to aid in effectively sealing the bag against stack ends with uneven length butt ends of lumber. By sealing, via the bag, the butt ends of one stack to the butt ends of the end opposed stacks, end checking is reduced or eliminated. In an alternate embodiment, a kiln having two cribs separated by a central heating coil, and appropriately conventionally ducted, might employ baffle bags only at the top of a product stack in each crib with air forced through the sides of both stacks from the outside stack surfaces to be drawn upwardly then into centrally located fans. However, any inflatable bag arrangement, including a single continuous bag around one or more sides of a stack, would also be within the scope of the invention. It will be appreciated however, by those skilled in the art, that baffle bag arrangements which provide for constraining less than all of the drying airflow are readily adaptable from the apparatus of the invention, simply by selectively under inflating, not inflating at all, or arbitrarily reducing the area coverage, one or more of the bags disposed around the product stack.

The preferred bag material will generally be any durable, resilient, relatively inelastic material selected to resist prolonged periods of the heat and humidity as anticipated in any particular kiln application, and to last over thousands of inflation cycles. A material known as Shelter-Right XR-5 8130, available from Seaman Corporation, 1000 Ventura Boulevard, Wooster, Ohio 44691, has been found to be a generally suitable bag material. For the above disclosed special end bags, the outer covering should be a spongy foam rubber approximately 1" thick which will yield to the bag's pressure against the butt ends. Preferably, each bag has its own conventionally arranged air inlet together with a suitable conduit to a source of pressurizing or inflating air for selective individual bag inflation. This source of air is preferably a separate blower selected to have a capacity for relatively quick bag inflation and to generate sufficient pressure inside the bag to provide the pressure per square foot needed in the lumber straightening application as disclosed more particularly herein. However, ducting off from the same fans employed to circulate the drying airflow may also be used to inflate the air bags without departing from the scope of the invention.

Each bag can be constructed in any conventional manner appropriate to the material selected for the bag and may be seamed or unseamed. A bag may have end panels and be made up from multiple panels of material conventionally seamed together, or may be a single piece of material and be seamed like a pillow. The length of the top, bottom, or side bag is typically chosen to be the length of the usual green product stack, and the width of the bag selected to conform to the width, or as the case might be, the height of the kiln or, in multiple crib kilns, the height or width of the crib. Some bag lengths may be made to cover more than one stack, such as a bag the length of the kiln. End bags have dimensions similarly selected to accommodate the dimensions of the end of the kiln or crib, as the case might be.

As principal variations in overall product load dimensions will be in the variances between heights of the stacks, the top bag is generally selected to be able to accommodate the widest distance between the top of a particular multiple stack product load and the effective ceiling of the kiln's drying space. This effective ceiling is usually the fan deck: because in typical conventional kilns the fans all sit above the drying space. A preferred top bag can inflate to a maximum of 30 inches below the fan deck. A recommended minimum inflation of 10 inches below the fan deck should be employed so that product stacks should not be higher than within 10 inches of the fan deck. This allows for optimum uniformity of pressure inside the bag. Other bags will also on occasion need to accommodate variations both in stack surface dimensions between stacks and in projections from a given stack surface.

The apparatus of the invention also provides for a means to raise the deflated top bag material, or the material of the special end bags, above the product load during the times when the product load is being placed into or out of the kiln drying area. A pair of synchronously turning pipe rollers are disposed one on either side of the top bag and preferably so linked together that they turn in opposite directions when they are rotated. Three inch wide lengths of conventional high temperature belting material are conventionally attached at each end of each length to one each of the pair of pipe rollers.

Each strap has a length sufficient to permit maximum inflation of the bag against the top of the product, and sufficient straps are employed along the lengths of the rollers to provide, in a preferred embodiment, approximately a three foot spacing between straps. Thus when the rollers are turned they each reel in a portion of the strap to raise the deflated bag material. Of course, other roller arrangements could be made to serve, including rollers turning in the same direction with appropriately offset strap mountings, or a single turning roller with the other end of the strap affixed to a stationary pipe or rail, without departing from the scope of the invention.

The method of the invention comprises the steps of (1) arranging within a conventional drying kiln having a stacked product load therein a system of inflatable baffle bags, preferably four bags, one for each of four of the six sides of a typical product stack, each bag substantially the same dimensions as the respective dimensions of the side of the stack to which it is assigned, and (2) inflating the baffle bag system with air from a source to create an inflation pressure within each bag sufficient to withstand the force of the drying airflow employed in the kiln and thus to effectively seal the bag material against the respective sides of the product stack and against themselves and thereby prevent drying airflow from escaping around the product stack.

BEST MODE OF ACCOMPLISHING THE INVENTION

Figure 1:
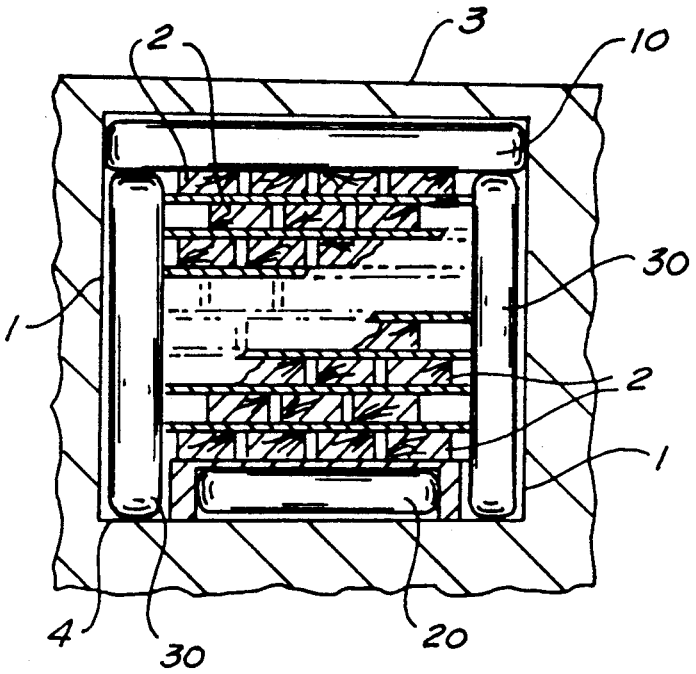
FIG. 1 is an end cross section of an embodiment of the invention.

Referring now to the drawings wherein like numbers indicate like parts, an embodiment of the invention is depicted in FIG. 1. A drying kiln having walls 1, floor 4, fan deck 3, and a stack of product 2, is shown baffled for endwise airflow through stack 2 by inflated top bag 10, bottom bag 20, and side bags 30. The pressure in each of the baffle bags may be independently regulated to achieve effective sealing of the bags against the respective surfaces of stack 2 and, in the case of top baffle bag 10, to achieve optimal compression of stack 2 by the uniform force exerted by inflated top bag 10 against the top of the stack of product 2.

Figure 2:
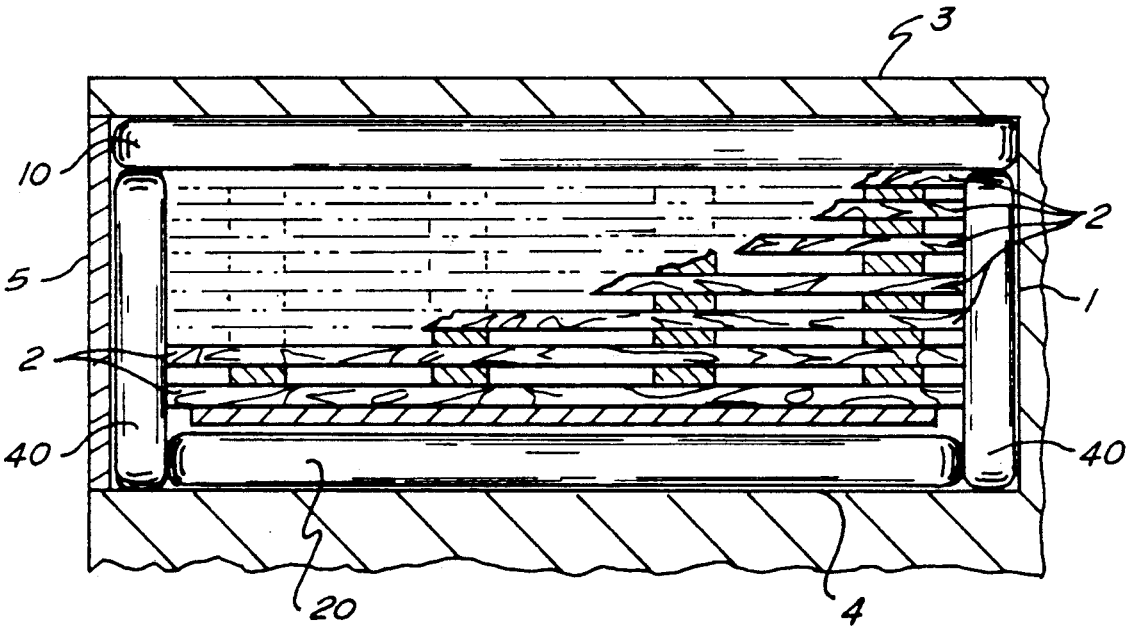
FIG. 2 is a side cross section of an alternate embodiment of the invention.

In FIG. 2 an alternate baffle bag arrangement is depicted which is optimized for drying airflow through the sides of the stack of product 2, instead of through the ends of the product stack as shown in FIG. 1. In a manner similar to that described for the embodiment shown in FIG. 1, top bag 10, bottom bag 20, and end bags 40 are inflated to seal the surfaces of stack 2 and to provide compression on the top of stack 2. In FIG. 2 stack 2 has been loaded into the kiln through kiln door 5 and one of the end bags 40 is disposed to exert pressure against the end of the product stack 2 and kiln door 5.

Figure 3:
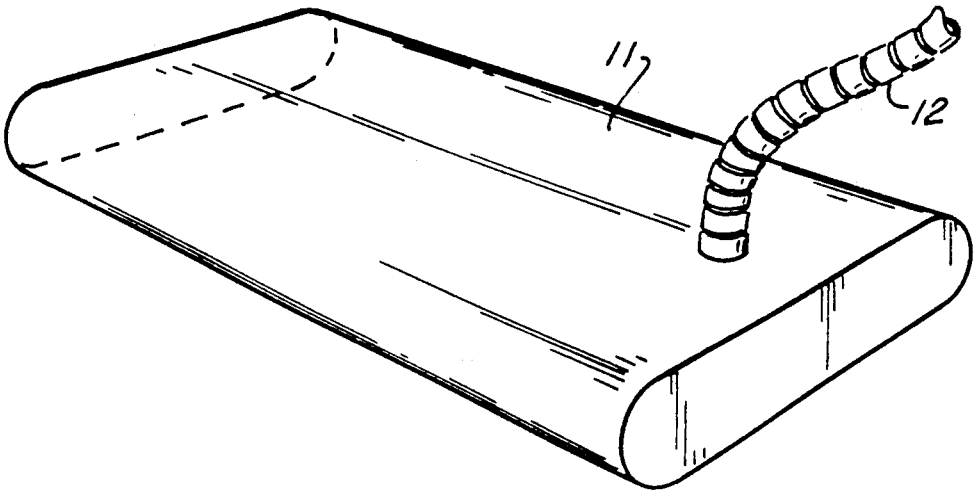
FIG. 3 is an isometric view of a typical baffle bag of the invention.

In FIG. 3 a typical baffle bag 11 is depicted showing the means by which the inflating air enters bag 11 through boot 12 from an air source (not shown).

Figure 4:
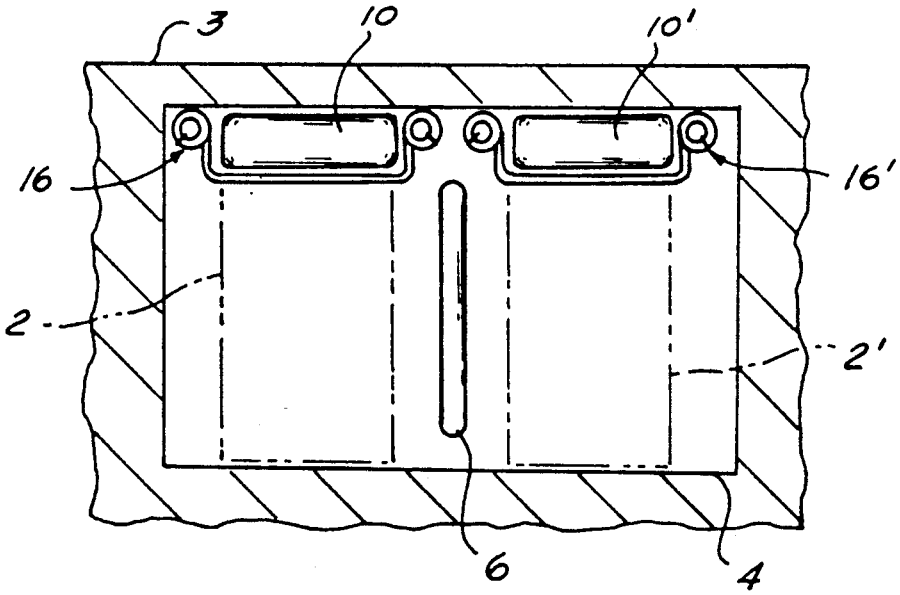
FIG. 4 is an end view of an alternate embodiment of the invention.

In FIG. 4 is schematically depicted an alternative embodiment of the invention disposed within a double kiln. Two stacks of product 2 and 2' separated by center coil 6 are disposed within the kiln and are sealed at the top of each of said stacks by separate top bag 10 and 10'. Also depicted is bag raising means 16 and 16' for rasing the material of top bag 10 and 10' away from the surface of the top of product stacks 2 and 2' and toward fan deck 3 when said product is to be taken in or out of the kiln.

Figure 5:
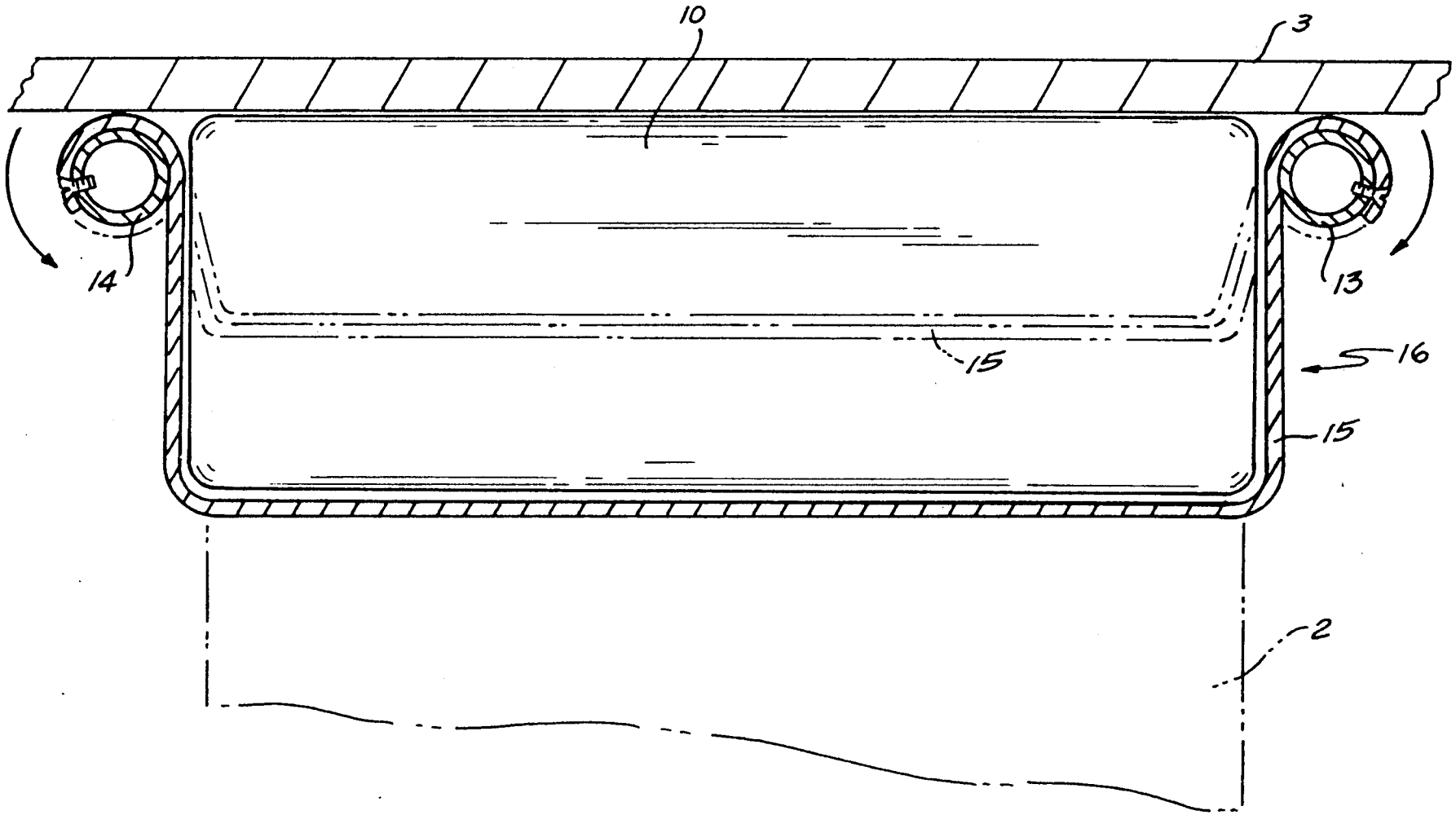
FIG. 5 is a detail of the bag raising mechanism 16 shown in FIG. 4.

In FIG. 5, bag raising means 16 is shown in detail. It is comprised of a pair of synchronously turning, but oppositely rotating roller shafts 13 and 14 to which is attached one or more lengths of strap 15 or sufficient length that when unwound, air bag 10 may fully inflate and exert pressure against product stack 2, but which when pulled up upon rollers 13 and 14 raises the material of bag 10 up toward fan deck 3. Rollers 13 and 14 are conventionally connected to suitable mechanical drive means such as electric motors or the like through pulleys, gears, chain drives or the like to achieve the required synchronous, but opposite, rotation. Alternately a weighted wire rope may be wrapped around one end of one of said interconnected pair of rollers for manual operation in a conventional fashion.

Preferably, a three inch strapping material is employed approximately every three feet along the length of shafts 13 and 14. Roller shafts 13 and 14 are preferably at least as long as bag 10 and a three to four inch diameter pipe has been found to be a suitable roller shaft material. The detail of the bag raising means 16 is shown in FIG. 5 with the deflated bag contour shown in broken lines.

During tests comparing a simulated conventional kiln with a kiln equipped with the apparatus of the invention, airflow through the product stack ("through the stickers") was approximately doubled in the invention equipped kiln without changing any other parameters. A 60 foot kiln was loaded with approximately 96,000 board feet of 2 inch thick lumber product on $\frac{5}{8}$ inch stickers spaced 18 inches on center. Conventional inlet and exhaust fans each delivering 20,000 cubic feet per minute were turned full on to produce a total of 60 fan horsepower, and air temperature was approximately 65 degrees Fahrenheit. A Sierra Model 618 SS48 I-200 temperature compensated air velocity measuring probe was used to take readings from top to bottom and every 12 feet along the kiln length. Average air velocity in the "simulated" kiln was 477 feet per minute (fpm); in the "invention" kiln it averaged 1061 fpm.

In compliance with the statute, the invention has been described in language more or less specific as to structural features. It is to be understood, however, that the invention is not limited to the specific features shown, since the means and construction herein disclosed comprise the preferred from of putting the invention into effect. The invention is claimed in any of its forms or modifications within the legitimate and valid scope of the appended claims, appropriately interpreted in accordance with the doctrine of equivalents.

I claim:

1. A method of directing a drying airflow in a drying kiln through a stack of product, said stack generally having top, bottom, end, and side stack surfaces, said method comprising the steps of:

(a) disposing within said kiln one or more inflatable baffle bags for engagement with at least one of said stack surfaces;

(b) inflating said bags to a pressure sufficient to resist displacement by said drying airflow so that said bags cover a substantial portion of said engaged stack surface from exposure to said airflow.

2. The method of claim 1 comprising the further step of:

(c) after inflating said bag, initiating said airflow.

3. The method of claim 1 wherein said inflatable baffle bags are disposed within said kiln in step (a) to constrain said airflow from flowing across said stack surface.

4. The method of claim 3 wherein said inflatable baffle bags are disposed within said kiln to further constrain said airflow from flowing across any substantial portion of said top, bottom, and side stack surfaces.

* * * * *